US007829779B2

(12) United States Patent
Suzuki

(10) Patent No.: US 7,829,779 B2
(45) Date of Patent: Nov. 9, 2010

(54) ELECTRONIC MUSIC RECORDING APPARATUS, METHOD, AND COMPUTER-READABLE MEDIUM CONTAINING A PROGRAM THEREFOR INHIBITING RECORDING BASED ON COPYRIGHT

(75) Inventor: Daisuke Suzuki, Hamamatsu (JP)

(73) Assignee: Yamaha Corporation (JP)

( * ) Notice: Subject to any disclaimer, the term of this patent is extended or adjusted under 35 U.S.C. 154(b) by 603 days.

(21) Appl. No.: 11/778,653

(22) Filed: Jul. 17, 2007

(65) Prior Publication Data

US 2008/0017018 A1 Jan. 24, 2008

(30) Foreign Application Priority Data

Jul. 18, 2006 (JP) ..... 2006-195096

(51) Int. Cl.
*G10H 7/00* (2006.01)

(52) U.S. Cl. ..... 84/645; 726/26

(58) Field of Classification Search ..... 84/645; 726/26

See application file for complete search history.

(56) References Cited

U.S. PATENT DOCUMENTS 6,810,200 B1 * 10/2004 Aoyama et al. ..... 386/94
7,351,904 B2 * 4/2008 Tamori ..... 84/609
7,653,131 B2 * 1/2010 Pan et al. ..... 375/240.08
2003/0029304 A1 * 2/2003 Ochi ..... 84/609
2006/0180009 A1 * 8/2006 Komano ..... 84/645

FOREIGN PATENT DOCUMENTS

JP HEI-8-211864 A 8/1996
JP 2003-58150 A 2/2003
JP 2004-45706 A 2/2004

* cited by examiner

*Primary Examiner*—Jeffrey Donels
(74) *Attorney, Agent, or Firm*—Rossi, Kimms & McDowell LLP

(57) ABSTRACT

An electronic music apparatus has a tone generator section that generates tone signals based on at least one of performance operation or automatic performance data. The generated tone signals are recorded by a recording section for a predetermined time. When tone signals to be generated by the tone generator section on the basis of automatic performance data requiring copyright protection, recording by the recording section is temporarily stopped. Then, upon completion of the generation of the tone signals based on the automatic performance data requiring copyright protection, recording by the recording section is automatically resumed. Alternatively, for a period from the start to end of the generation of the tone signals based on automatic performance data requiring copyright protection, the recording section is inhibited from recording the tone signals based on the automatic performance data requiring copyright protection.

16 Claims, 4 Drawing Sheets

ELECTRONIC MUSIC RECORDING APPARATUS, METHOD, AND COMPUTER-READABLE MEDIUM CONTAINING A PROGRAM THEREFOR INHIBITING RECORDING BASED ON COPYRIGHT

BACKGROUND

Apparatuses designed to constantly record music performance data based on user's performance operation on a keyboard or the like have been known, for example, from Japanese Patent Application Laid-open Publication No. HEI-8-211864. Further, apparatus designed to convert music piece data from a performance data format, such as the MIDI format, to an audio data format have been known, for example, from Japanese Patent Application Laid-open Publication No. 2004-45706. Furthermore, music apparatuses designated to protect a copyright of automatically-performed music piece data have been known, for example, from Japanese Patent Application Laid-open Publication No. 2003-58150.

It is conceivable to constantly record tone signals, formed on the basis of user's performance operation, in a digital audio format while simultaneously reproducing automatic performance data. However, in the conventionally-known techniques, no consideration has been given as to appropriate measures in cases where automatic performance data, of which protection of the copyright is required, are reproduced during the constant recording.

SUMMARY OF THE INVENTION

The present disclosure provides a technique for constantly recording music information, based on performance operation and automatic performance data, in a digital audio format. In particular, the present invention relates to an electronic music apparatus, a music information recording method, and a computer-readable medium storing a computer program for recording generated tones based on performance operation or automatic performance data, while providing copyright protecting.

One aspect of the present invention is an electronic music apparatus that has a tone generator section that generates tone signals based on at least one of performance operation or automatic performance data, a recording section that records the tone signals being generated by the tone generator section for a predetermined time, and a recording control section that inhibits recording, by the recording section, of at least the tone signals being generated by the tone generator section based on the automatic performance data requiring copyright protection, while permitting recording, by the recording section, of the tones being generated by the tone generation section based on at least the automatic performance data requiring no copyright protection. This allows recording of tone waveform signals that are based on performance operation and/or automatic performance data, while protecting copyright.

The recording section can have a limited storage capacity, and can constantly store therein the latest tone signals for a predetermined period corresponding to the limited storage capacity.

The recording section can continue recording even when no tone signal (silent state) is being supplied to the recording section, and once tone signal formation is resumed following the no tone signal, the recording section can record a marking indicative of a start of a performance. The marking can be recorded at a time position, a predetermined time before a time point when the tone signal formation is resumed following the no tone signal (silent state).

The recording control section can include a detection section that detects whether or not the automatic performance data input to the tone generator section contains copyright information. When the detection section detects the copyright information, the recording control section determines that the automatic performance data requires copyright protection.

According to one embodiment, the recording control section temporarily stops recording when the tone signals are being generated based on the automatic performance data requiring copyright protection, and automatically resumes recording, by the recording section, upon completion of generation of the tone signals based on the automatic performance data requiring copyright protection.

According to another embodiment, the recording control section, for a period from the start to end of generation, by the tone generator section, of the tone signals based on the automatic performance data requiring copyright protection, inhibits recording, by the recording section, of only the tone signals being generated based on the automatic performance data requiring copyright protection.

The tone generator section can generate a plurality of channels of tone signals. In this respect, the generated tone signals associated with the automatic performance data requiring copyright protection can be assigned to a different channel(s) from the channel(s) assigned to the generated tone signals associated with at least the automatic performance data requiring no copyright protection. In this respect, for a period from the start to end of generation, by the tone generator section, of the tone signals based on the automatic performance data requiring copyright protection, the recording control section can inhibit recording, by the recording section, of the tone signals only from each of the channels that is assigned to the tone signals being generated based on the automatic performance data requiring copyright protection, while continuing recording of signals from each of the channels that is not inhibited.

Another aspect of the present invention is a music information recording method for a computer functioning as the above-mentioned electronic music apparatus. The method includes a recording step of recording the tone signals being generated by the tone generator section for a predetermined time, and a control step of inhibiting recording, in the recording step, of at least the tone signals being generated by the tone generator section based on the automatic performance data requiring copyright protection, while permitting recording, in the recording step, of the tone signals being generated by the tone generator section based on at least the automatic performance data requiring no copyright protection.

The control step can temporarily stop recording, in the recording step, when the tone signals are being generated based on the automatic performance data requiring copyright protection, and can automatically resume recording, in the recording step, upon completion of generation of the tone signals based on the automatic performance data requiring copyright protection.

Alternatively, the control step, for a period from the start to end of generation, by the tone generator section, of tone signals based on the automatic performance data requiring copyright protection, can inhibit recording, in the recording step, of only the tone signals being generated based on the automatic performance data requiring copyright protection.

When the tone generator section can generate a plurality of channels of tone signals, for a period from the start to end of generation, by the tone generator section, of the tone signals based on the automatic performance data requiring copyright protection, the recording control step can inhibit recording, in the recording step, of the tone signals only from each of the channels that is assigned to the tone signals being generated based on the automatic performance data requiring copyright protection, while continuing recording of signals from each of the channels that is not inhibited.

Another aspect of the present invention is a computer-readable medium containing a computer program for a computer functioning as the above-described electronic music apparatus. The program includes a recording module for recording the tone signals being generated by the tone generator section for a predetermined time, and a control module for inhibiting recording, by the recording module, of at least the tone signals being generated by the tone generator section based on the automatic performance data requiring copyright protection, while permitting recording, by the recording module, of the tone signals being generated by the tone generation section based on at least the automatic performance data requiring no copyright protection.

The recording control module can temporarily stop recording, by the recording module, when the tone signals are being generated based on the automatic performance data requiring copyright protection, and automatically resumes recording, by the recording module, upon completion of generation of the tone signals based on the automatic performance data requiring copyright protection.

Alternatively, the control module, for a period from the start to end of generation by the tone generator section of the tone signals based on the automatic performance data requiring copyright protection, can inhibit recording, by the recording module, of only the tone signals being generated based on the automatic performance data requiring copyright protection.

When the tone generator section is for generating a plurality of channels of tone signals, for a period from the start to end of generation, by the tone generator section, of the tone signals based on the automatic performance data requiring copyright protection, the recording control module can inhibit recording, by the recording module, of the tone signals only from each of the channels that is assigned to the tone signals being generated based on the automatic performance data requiring copyright protection, while continuing recording of signals from each of the channels that is not inhibited.

DETAILED DESCRIPTION

Figure 1:
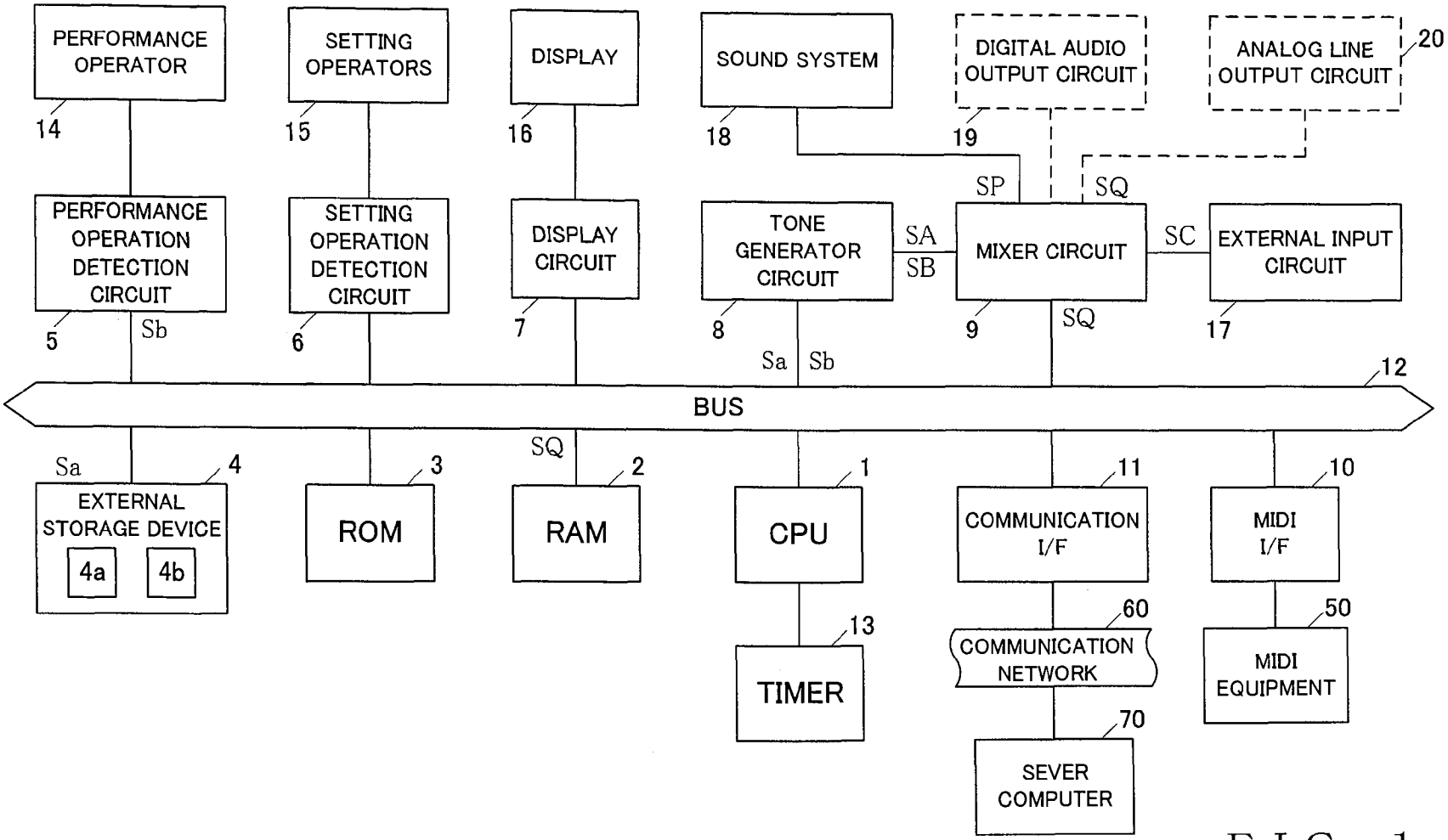
FIG. 1 is a block diagram showing a general hardware setup of an electronic music apparatus in accordance with an embodiment of the present invention.

FIG. 1 is a block diagram showing a general hardware setup of an electronic music apparatus in accordance with an embodiment of the present invention. This electronic music apparatus can be based on a computer that includes a performance operation section and tone signal formation section (module) as in the conventional electronic musical instruments, and also has a predetermined music information processing function. The electronic music apparatus includes a central processing unit (CPU) 1, a random access memory (RAM) 2, a read-only memory (ROM) 3, an external storage device 4, a performance operation detection circuit 5, a setting operation detection circuit 6, a display device 7, a tone generator circuit 8, a mixer circuit 9, a MIDI interface (I/F) 10, a communication interface (I/F) 11, etc., and these components 1-11 are interconnected via a bus 12.

The CPU 1 constitutes a data processing circuit in conjunction with the RAM 2 and ROM 3, and it performs various music information processing, including a recording process, in accordance with predetermined control programs and clock signals output from a timer 13. At the time of the above-mentioned processing, the RAM 2 is used as a working area for temporarily storing various data necessary for the processing. The ROM 3 stores in advance various control programs and control data necessary for the processing, as well as automatic performance data Sa and the like. In the recording process, for example, a storage area for retaining automatic performance data Sa to be reproduced and a storage area for recording (storing) digital audio data SQ are secured in the RAM 2, and the data processing circuit, which comprises components 1-3, functions as a digital recorder. Note that the digital audio data hereinafter will be referred to also as audio data or sound data, storage of these data will be referred to as "recording" and the storage area for these data will be referred to as "recording area."

The external storage device 4 includes not only built-in (internal) storage media, such as one or more of a hard disk (HD) and rewritable non-volatile semiconductor memory like a flash memory, but also various portable external storage media, such as one or more of a compact disk read-only memory (CD-ROM), flexible disk (FD), magneto-optical disk (MO), digital versatile disk (DVD), and smart medium®. Control programs and desired data can be stored in the external storage device 4.

The external storage device (e.g., HD) 4 includes an automatic performance data storage area 4*a* for storing a multiplicity of automatic performance data Sa, and an audio data storage area 4*b* for storing audio data obtained in the recording process. Whereas the automatic performance data stored in the ROM 3, external storage device 4, etc., are tone-event progressing type data described in the MIDI format, the audio data are tone waveform data indicative of tone waveforms.

The performance operation detection circuit 5 detects performance operation on a performance operator 14, such as a keyboard, and supplies actual performance data Sb of the MIDI format, corresponding to the detected performance operation, to the tone generator circuit 8 under control of the data processing circuit. The setting operation detection circuit 6 detects setting operation on any of setting operators 15, such as a key switch or mouse, and supplies setting data, corresponding to the detected setting operation, to the data processing circuit. The setting operators 15 include, for example, switches for setting conditions of tone signal formation (generation) in the tone generator circuit 8, marking position designating switch, jump instructing switch, storage switch, etc.

The setting operators 15 also can include a mode cancellation switch for canceling a recording mode, as necessary. Namely, in this electronic music apparatus, where the recording mode is set in response to turning-on of a power switch to perform constant recording as will be later described, another operation mode involving no recording can also be set by the user operating the mode cancellation switch to cancel the recording mode. The recording mode can be resumed by the user re-operating the mode cancellation switch.

The display circuit 7 controls display/illumination of a display 16, such as a screen displaying LCD, and various indicators (not shown) in accordance with instructions from the CPU 1, to provide display assistance corresponding to operation of the operators 14 and 15.

The tone generator circuit 8, which is a tone signal formation (generation) module having a tone generator and DSP, forms (or generates) tone signals SB and SA based on performance operation (also referred to as manual performance) and automatic performance data. Namely, for tone signal generation responsive to performance operation (i.e., manual performance), the tone generator circuit 8 forms actual performance tone signals SB corresponding to actual performance data Sb generated by the performance operation detection circuit 5 in response to performance operation on the performance operator 14, in accordance with a condition set via the setting operators 15. Further, for tone signal generation based on automatic performance data, the tone generator circuit 8 forms automatic performance tone signals SA by reproducing automatic performance data Sa of a desired music piece loaded from the storage devices 3, 4 or the like into the RAM 2. The above-mentioned tone signals SA and SB are audio data indicative of tone waveforms and hereinafter will be generically referred to as "performance audio data" or "performance sound data". Accordingly, tone signals SB based on performance operation will hereinafter be referred to as "actual performance audio data" or "actual performance sound data," while tone signals SA based on automatic performance data will be referred to as "automatic performance audio data" or "automatic performance sound data."

The mixer circuit 9 mixes audio data input via predetermined input terminals and outputs mixed audio data via predetermined output terminals, by performing mixing control on input/output states of audio data on the basis of path control information given from the above-mentioned data processing circuit. The tone generator circuit 8, external audio input audio circuit 17 and sound system 18 are connected to the mixer circuit 9, and a digital audio output circuit 19 and analog line output circuit 20 can also be connected to the mixer circuit 9 as necessary.

The external audio input circuit 17 converts analog sound signals, such as those of a song, input via a microphone or the like into digital audio data, and receives digital audio data from other audio input equipment, such as an electric guitar, via a line input, to thereby supply the mixer circuit 9 with these received data as externally-input audio data (external input sound data). The sound system 18, which includes a D/A conversion section, amplifier, and speaker, audibly reproduces tones based on audio data SP output from the mixer circuit 9.

The digital audio output circuit 19 supplies other digital audio data SQ, output from the mixer circuit 9, to external digital audio equipment, such as a CD writer, capable of storing data. The analog line output circuit 20 converts the digital audio data SQ, output from the mixer circuit 9, to analog representation and supplies, via a line output, the converted analog audio data to external analog audio equipment, such as a tape recorder, capable of storing data.

In the recording mode, the mixer circuit 9 mixes performance audio data SA and SB and external input audio data SC supplied from the external audio input circuit 17, and outputs the mixed audio data SP to the sound system 18. The mixer circuit 9 also outputs, as other audio data SQ, a recordable portion of the audio data SP to a recording area (digital recorder) within the RAM 2. These audio data SQ are audio data for a latest predetermined time period obtainable by constant recording. In a second embodiment of the recording process to be later described, the audio data SQ also can be output to the output circuits 19 and 20.

To the MIDI I/F 10 is connected an external MIDI equipment 50 having a MIDI music information processing function similar to that of the instant embodiment of the electronic music apparatus. Via the MIDI I/F 10, MIDI performance data can be communicated between the instant embodiment of the electronic music apparatus and the external MIDI equipment 50. Further, external performance data from the external MIDI equipment 50 can be used for formation of performance audio data via the tone generator circuit 9, similarly to the actual performance data and automatic performance data.

A communication network 60, such as the Internet or local area network (LAN), is connected to the communication I/F 11, so that a desired control program and automatic performance data can be downloaded from an external server computer 70 or the like. The automatic performance data downloaded from the external server computer 70 or the like can be stored into the automatic performance data storage area 4*a* of the external storage device 4 for use in the instant embodiment of the electronic music apparatus.

Figure 2A:
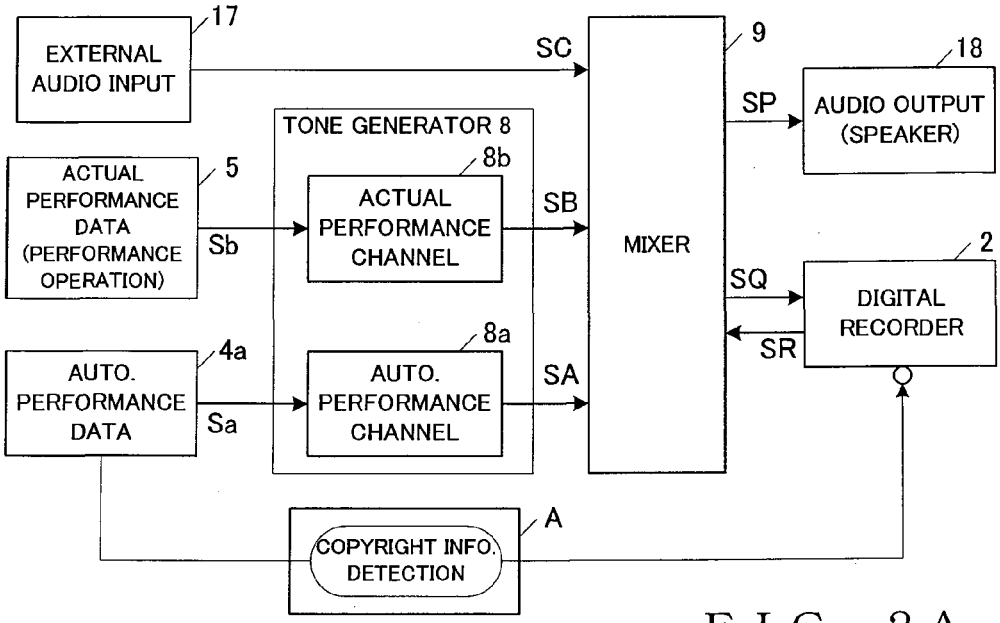
FIGS. 2A and 2B are functional block diagrams explanatory of first and second embodiments of a recording process performed in the electronic music apparatus of FIG. 1.
Figure 2B:
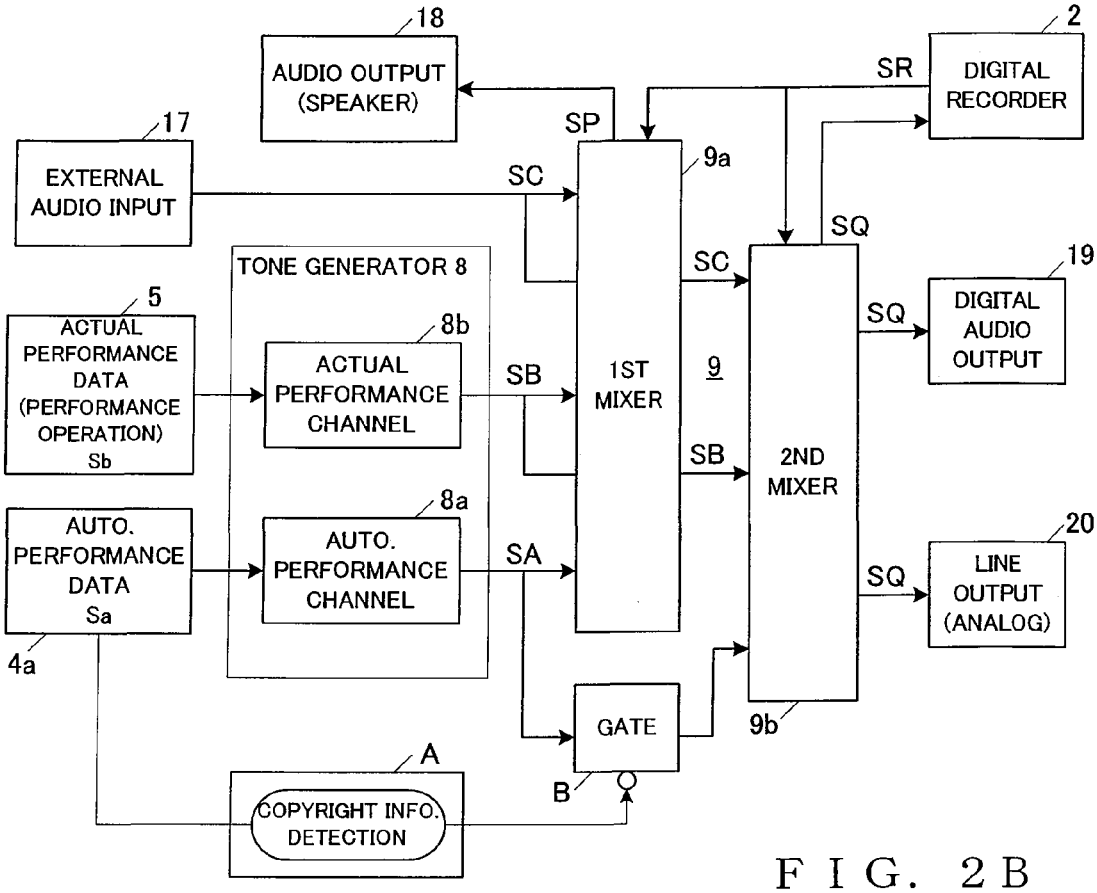

In the recording mode, the electronic music apparatus according to the embodiment of the present invention performs the recording process so that it can, not only generate tones based on an automatic performance, actual performance, and external input audio data SA-SC, but also constantly record recordable audio data into the digital recorder in a predetermined manner. The recording process can be performed either in the first embodiment as shown in FIG. 2A or in the second embodiment as shown in FIG. 2B. FIGS. 2A and 2B are functional block diagrams explanatory of the first and second embodiments of the recording process.

In FIGS. 2A and 2B, the tone generator circuit 8, which has a multiplicity of (e.g., 64) tone generating channels, can simultaneously generate a multiplicity of tone signals on the basis of automatic performance data (e.g., song data and automatic accompaniment data) Sa prestored, for example, in the automatic performance data storage area 4*a* of the external storage device 4 and temporarily retained in the RAM 2 for reproduction, and actual performance data Sb based on actual performance operation on the performance operator (e.g., keyboard) 14. The automatic performance and actual performance signals SA and SB, generated by the tone generator circuit 8 on the basis of the performance data Sa and Sb, are input, as performance audio data, to the mixer circuit 9.

Different tone colors can be allocated to the tone generating channels of the tone generator circuit 8, and tone signals SA and SB of different tone colors (or of the same tone color) can be formed on the basis of automatic performance events of the automatic performance data Sa and actual performance events of the actual performance data Sb. The "automatic performance . . . " blocks and the "actual performance (performance operator) . . . " blocks are indicated separately in FIGS. 2A and 2B to facilitate understanding. In normal cases, however, performance events of the automatic performance data Sa and performance events of the actual performance data Sb can be allocated to desired ones of the multiplicity of tone generating channels.

The "external audio inputs" in the figures indicate external input audio data SC received from the external audio input circuit 17 via the microphone or line input. Once the above-mentioned automatic performance, actual performance and external input audio data SA, SB, and SC are input to the mixer circuit 9, the mixer circuit 9 mixes the input audio data SA, SB, and SC and outputs thus-mixed audio data SP to the sound system 18 so that the mixed audio data are audibly reproduced or sounded through the speaker of the sound system 18. Further, recordable audio data, corresponding to the latest predetermined period, of the mixed audio data SP are constantly recorded into the digital recorder.

Namely, for the constant recording, once a predetermined first set time (T1) passes or elapses from the start of the recording, the digital recorder records new audio data while deleting, from audio data already recorded therein, a predetermined portion of audio data that corresponds to a predetermined second set time (T2) from the beginning of the already-recorded audio data. By then repeating such new audio data recording while deleting previous (old) audio data every time the first set time (T1) has elapsed, the digital recorder can constantly record audio data for the latest predetermined period (i.e., period within a time range from "T1-T2" to "T1"). Such a form of recording is herein referred to as "constant recording", by which a human player can perform comfortably without being conscious that "recording" is going on and can constantly have audio data SQ, having contents of a performance, accumulated in a quantity corresponding substantially to the predetermined time T1. In the instant embodiment of the electronic music apparatus, a recording area within the RAM 2 is used for the digital recorder 2 to record the audio data SQ for the predetermined period.

In the automatic performance data Sa, copyright information Cp is attached if copyright protection is required. Thus, whether the copyright protection is required or not is indicated by presence/absence of the copyright information Cp. Thus, in the instant electronic music apparatus, a protection information detection section A is caused to operate in the recording process so that data requiring copyright protection cannot be recorded as the digital audio data SQ. According to the instant embodiment of the electronic music apparatus, the copyright information need not be attached to all of automatic performance data. Namely, the copyright information can be attached to only automatic performance data requiring protection of the copyright Sa.

Once the protection information detection section A detects the copyright information Cp from automatic performance data Sa when starting reproduction of the automatic performance audio data Sa in the recording mode, the protection information detection section A controls the digital recorder 2 or mixer circuit 9 to inhibit recording, into the digital recorder 2, of the automatic performance audio data SA to protect the copyright of the automatic performance data Sa.

Further, in the instant embodiment, audio data SR already recorded in the digital recorder 2 can be reproduced in a retroactive manner. In such a case, the mixer circuit 9 switches the data input/output paths as required so that the audio data SR already recorded in the digital recorder 2 can be output to the sound system 18. The recorded audio data SR are reproduced by the sound system 18 with a reproduction start point of the data SR returned to a position automatically marked at the time of the recording, during which time constant recording into the digital recorder 2 is continued.

Further, as necessary, a portion of the recorded audio data SR can be cut out or extracted and stored permanently into an audio data storage area 4*b* of the external storage device 4. In such a case, the constant recording into the digital recorder 2 is temporarily stopped, a portion of the recorded audio data SR is cut-out and stored on the basis of the position marked at the time of the recording, and the constant recording is resumed after completion of the storage of the extracted audio data.

In the first embodiment of the recording process, as shown in FIG. 2A, the aforementioned various operations are performed using the single mixer module 9. Namely, as basic operations of the mixer 9, the mixer 9 mixes performance audio data SA and SB from the channels 8*a* and 8*b* of the tone generator circuit 8 and external input audio data SC from the external audio input circuit 17 and then outputs the thus-mixed audio data to the sound system 18 and digital recorder 2. In this case, for audio data recording, the digital recorder 2 records recordable audio data SQ under predetermined control by the protection information detection section A.

When the protection information detection section A detects copyright information from automatic performance data Sa, it halts or inhibits the recording operation of the digital recorder 2 if reproduction of the automatic performance data Sa is in progress. Namely, the constant recording by the digital recorder 2 is temporarily stopped once reproduction of automatic performance data containing copyright protection information is started, and it is resumed upon completion of the reproduction of the automatic performance data. Thus, in reproduction of the automatic performance data Sa including the copyright information, audio data SQ, having removed therefrom data of a time period over which the automatic performance data Sa is reproduced, is recorded, as recordable tone data, into the digital recorder 2.

The second embodiment of the recording process includes a second mixer module 9*b* and a control gate B in addition to the elements employed in the first embodiment of the recording process. Namely, as shown in FIG. 2B, the second embodiment of the recording process employs the two mixer modules 9*a* and 9*b* and controls the second mixer module 9*b* via the control gate B. The first mixer 9*a* in FIG. 2A is a mixer dedicated to audio data output only, and similarly to the mixer 9 in the first embodiment of the recording process, it mixes individual input audio data SA-SC, outputs the thus-mixed audio data SP to the sound system 18 and, if necessary, reproductively outputs audio data SP, recorded by the digital recorder 2, to the sound system 18 starting with a predetermined marking position of the audio data SP.

The second mixer 9*b* in FIG. 2B is provided for recording of audio data. Namely, whereas actual performance audio data SB from the actual performance channel (performance operator) 8*b* of the tone generator circuit 8 and external input audio data SC from the external audio input circuit 17 are always input to the first mixer 9*a*, automatic performance audio data SA from the automatic performance channel 8*a* are input to the second mixer 9*b* via the control data B controlled by the protection information detection section A.

More specifically, the control gate B controls passage therethrough of automatic performance audio data SA, corresponding to automatic performance data Sa to be reproduced, in accordance with presence/absence of copyright information of the automatic performance data Sa. That is, if the automatic performance data Sa contains copyright information, the control gate B blocks (i.e., inhibits passage therethrough) of the automatic performance audio data SA. But, if the automatic performance data Sa contains no copyright information, the control gate B permits passage therethrough of the automatic performance audio data SA so that the audio data SA are input to the second mixer 9*b*. Thus, in reproduction of the automatic performance data Sa including the copyright information, audio data SQ, in which the automatic performance audio data SA based on the automatic performance data Sa have been removed from the input audio data (SA-SC), are recorded, as recordable tone data, from the second mixer 9*b* into the digital recorder 2. For example, when all of the automatic performance, actual performance and external input audio data SA-SC have been input, only the actual performance and external input audio data SB and SC are recorded as recordable audio data SQ.

The recordable audio data SQ output from the second mixer 9*b* can be sent, via the digital output circuit 19 and analog line output circuit 20, to external digital audio equipment and external analog audio equipment where the thus-sent data can be stored and used in the individual external equipment. Further, the audio data SR already recorded in the digital recorder 2 can be, not only stored into the audio data storage area 4*b* of the external storage device 4, but also output to the output circuits 19 and 20 for use in the individual external equipment.

Namely, according to the novel features of the audio data recording performed in the instant embodiment of the electronic music apparatus, tone signals SB and SA formed by the tone generator 8 on the basis of performance operation Sb and automatic performance data Sa are constantly recorded, as recording data SQ, into the digital recorder 2 for the predetermined time period (T1-T2) to T1. At that time, some restriction is imposed on the constant recording of the recording data SQ, through the copyright information detection and restriction control functions of the protection information detection section A, when tone signals SA are to be formed on the basis of automatic performance data Sa requiring protection of the copyright. In the first embodiment of the recording process, the constant recording is temporarily stopped or paused once the copyright information is detected and formation or generation of tone signals SA based on the automatic performance data Sa, requiring protection of the copyright, is started, and then the constant recording is resumed upon completion of the tone formation (i.e., operations of block A to block 2 in FIG. 2A). In the second embodiment of the recording process, on the other hand, recording is inhibited, only for the tone signals SA, from the start to end of formation of the tone signals SA based on the automatic performance data Sa requiring protection of the copyright (i.e., operations of block A to block 9*a* via block B).

Figure 3:
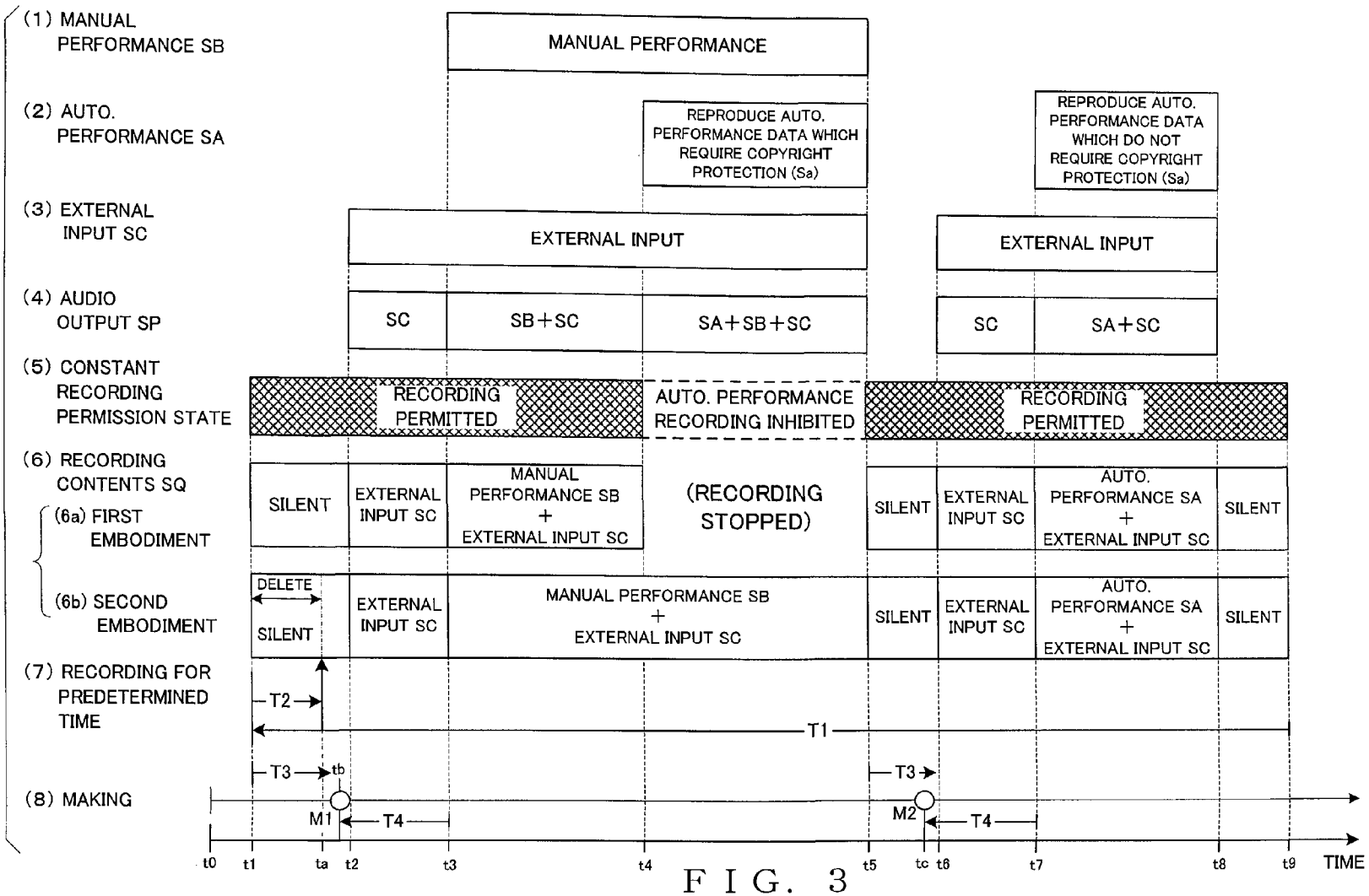
FIG. 3 a diagram showing examples of performance/input states and forms of constant recording in the recording process performed in the electronic music apparatus of FIG. 1.

FIG. 3 shows examples of performance/input states and forms of constant recording in the recording process in the instant embodiment of the present invention, with the horizontal axis representing the passage of time. In FIG. 3, (1)-(3) show example performance progressions based on a manual performance (performance operation), automatic performance, and external inputs, and (4)-(6) show audio outputs (sound outputs) SP, permission/inhibition state of constant recording, and contents SQ to be recorded by the constant recording.

Once the human player turns on a power supply to the electronic music apparatus at a time point t1 to bring the electronic music apparatus into the recording mode, the constant recording is started. In an initial period (t1-t2) when no performance is in progress yet, recording is possible as shown in (5) and (6) of FIG. 3, so that a silent state is recorded into the digital recorder. Then, once an external input is received at a time point t2 as indicated in (3) of FIG. 3, external input sound data SC based on the external input are output from the mixer circuit 9 to the sound system 18 but also recorded to the recorder. Then, once a manual performance (performance operation) is started at a time point t3 as indicated in (1) of FIG. 3, actual performance sound data SB based on the manual operation, as well as the external input sound data SC, is output and recorded as indicated in (4)-(6) of FIG. 3.

Further, once reproduction of automatic performance data Sa, requiring protection of the copyright, is started at a time point t4 as indicated in (2) of FIG. 3, automatic performance sound data SA based on an automatic performance, as well as the external input and actual performance sound data SC and SB, are output to the sound system 18. But through the function of the protection information detection section A, recording inhibition is set, as indicated in (5) of FIG. 3, so that, regardless of presence/absence of an external input and manual performance, recording of the automatic performance sound data SA is inhibited or stopped to effect a recording restriction. Namely, in the first embodiment of the recording process shown in FIG. 2A, the recording by the digital recorder is stopped as indicated in (6*a*) of FIG. 3, while, in the second embodiment of the recording process shown in FIG. 2B, only the actual performance and external input sound data SB and SC, excluding the automatic performance sound data SA, are recorded as indicated in (6*b*) of FIG. 3.

Then, once the reproduction of the automatic performance data Sa, requiring protection of the copyright, is ended at a time point t5, as indicated in (2) of FIG. 3, by the performance data Sa having been reproduced to the end or the reproduction of the data Sa having been terminated on the way, the music apparatus is restored to the recording-permitted state as indicated in (5) of FIG. 3. If the external input and manual performance too are stopped at the same time as indicated in (1) and (3) of FIG. 3 at the time point t5, no sound data is output for audible reproduction any longer following the time point t5. Thus, in the first embodiment, digital recording of a silent state is started t as indicated in (6*a*) of FIG. 3, while, in the second embodiment, the music apparatus shifts to digital recording of a silent state as indicated in (6*b*) of FIG. 3.

Further, once an external input is received at a time point t6 as indicated in (3) of FIG. 3, external input sound data SC is not only output for audible reproduction but also recorded as indicated in (6) of FIG. 3. Then, once automatic performance data Sa, which do not require protection of the copyright, is reproduced at a time point t7 as indicated in (2) of FIG. 3, the corresponding automatic performance sound data SA too is output for audible reproduction but also recorded as indicated in (4) and (6) of FIG. 3. Then, once the reproduction of the automatic performance data Sa, which do not require protection of the copyright, is completed and there is no more external input received at a time point t8 as indicated in (2) and (3) of FIG. 3, no more sound data is output for audible reproduction so that a silent state is recorded, as indicated in (4) and (6) of FIG. 3, after which this state continues.

Then, once the actual recording time reaches the predetermined first set time (e.g., one hour and five minutes) T1, a portion of recorded data, corresponding to the second set time (e.g., five minutes) T2 from the beginning of the already-recorded data, is deleted from the already-recorded data. For example, in the second embodiment of the recording process where the recording is continued, a portion of recorded data, from the start position t1 of the recorded audio data to a position ta the second set time T2 after the start position t1, is deleted at a time point t9 when the first set time T1 has elapsed from the recording start time point t1. After that, the second embodiment of the recording process records new data while deleting previous data, i.e. deleting, at a time point when the first set time T1 has elapsed from the time point ta, a portion of recorded data from the new start position ta to a position the second set time T2 after the new start position ta. In this way, the second embodiment of the recording process continues recording new data while sequentially deleting predetermined previous data at predetermined timing. In the first embodiment of the recording process which contains the recording pause period (t4-t5) as indicated in (6*a*) of FIG. 3, on the other hand, the elapse or passage of the first set time T1 is determined with the recording pause period (t4-t5) excluded from consideration.

The reproduction start time point of the automatic performance sound data and the manual performance (performance operation) start time point can often become reference points to be used in performing retroactive reproduction of audio data and in cutting out and storing a necessary portion of the audio data. Thus, in the instant embodiment of the present invention, a marking is made to (or recorded at) a recording position that corresponds to the start time point of an automatic performance or manual performance following a "performance-free state" of a predetermined time length (T3) or over. In this case, it is more preferable to make the marking a predetermined time (T4) before the start time point. By thus setting the marking point at "a predetermined time before the start time point", it is possible to raise the possibility that, even in retroactively reproducing or cutting out a portion of a music piece where "a song starts earlier than a performance", the song portion can be included in the reproduced or cut-out music piece portion.

For example, in a case where a "performance-free state" in which no performance, such as an automatic performance or manual performance, is present has lasted for the third set time (e.g., five minutes) T3 or over, and then an automatic performance or manual performance has been started following such a performance-free state, a time position tb or tc the fourth set time (e.g., 30 seconds) T4 before the start position t3 or t7 of the automatic performance or manual performance is chosen as a marking point (namely, so-called "instantly-accessible beginning position"), and a marking M1 or M2 is set at the time position tb or tc.

Whereas there have been conventionally known recorders arranged to make a marking at a time point when an "external-input-sound-absent" state has been changed to an "external-input-sound-present" state, the instant embodiment of the invention is arranged to make a marking in response to the start of a performance, not in accordance with presence/absence of an external input sound. This is because an external input sound, such as noise, can be produced independently of an intension of the human player and thus an unnecessary marking can be made if the conventionally-known marking scheme based on presence/absence of an external input sound is employed.

More specifically, according to the recorded data marking feature of the instant electronic music apparatus, tone signals SB, SA formed by the tone generator 8 on the basis of performance operation Sb and/or automatic performance data Sa and external input sound signal SC received via the external audio input circuit 17 are constantly recorded, as recording data SQ, into the digital recorder 2 for a predetermined latest time period (i.e., period within a time range from "T1-T2" to "T1"). Once it is detected, during that time, that the tone signal SB, SA has changed to a "signal-present" state at the time point t3 or t7 following a "signal-absent" state of the predetermined time length T3 or over, a marking M, M2 is set in the recording data SQ. The marking M1, M2 is set at the position tb or tc the predetermined time T4 before the time point t3 or t7, so that, in reproduction or storage of the recording data, it is possible to appropriately make instant access to the data in good time in accordance with the marking M1, M2.

Figure 4:
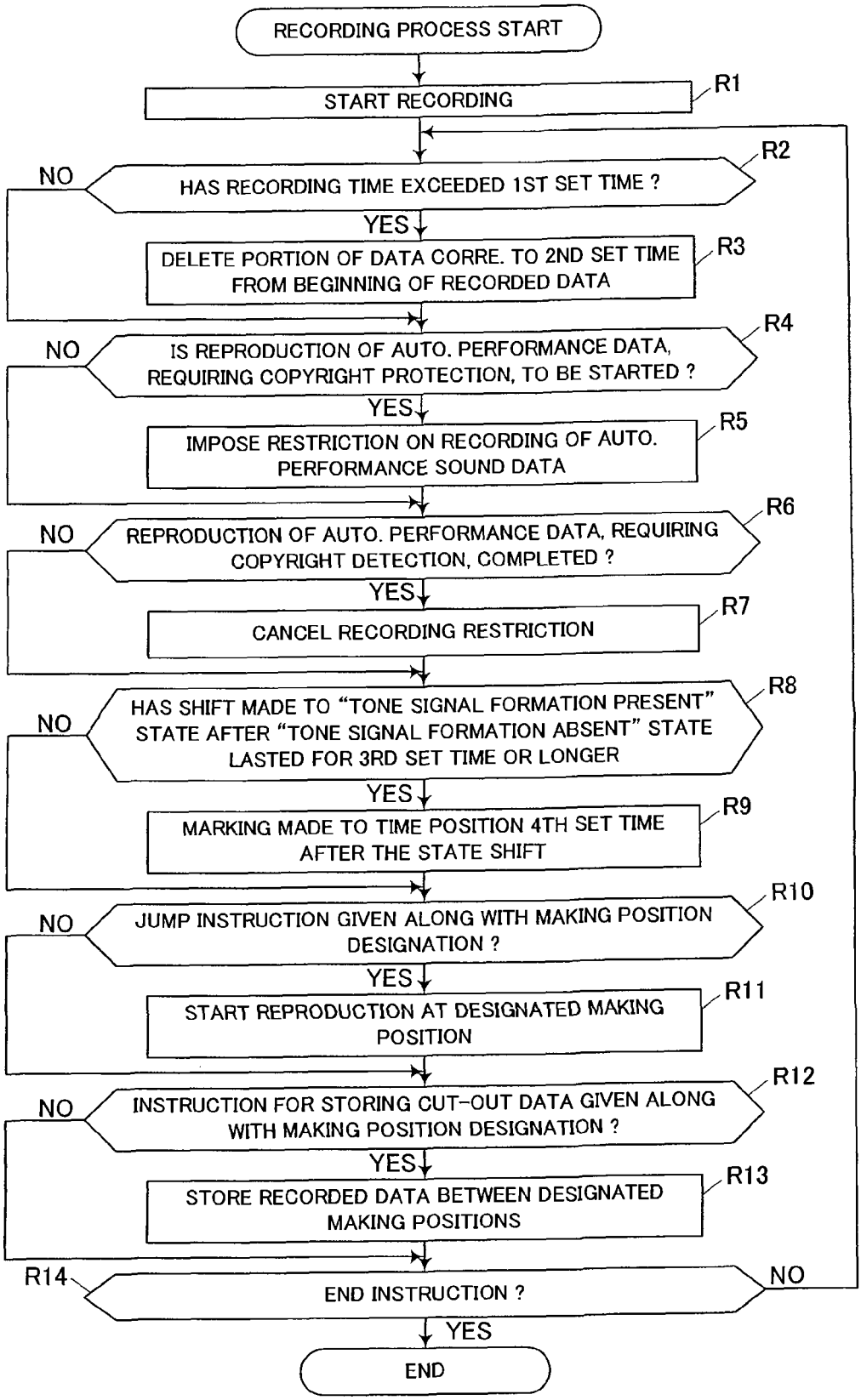
FIG. 4 is a flow chart showing the recording process performed in the electronic music apparatus of FIG. 1.

FIG. 4 is a flow chart showing an example of the recording process performed in the instant embodiment of the present invention. Upon powering-on of the electronic music apparatus, the recording process is started up, where a recording operation is initiated at step R1. At next step R2, a determination is made as to whether the recording time has exceeded the first set time T1. If the recording time has exceeded the first set time T1 (YES determination at step R2), the flow moves on to step R3 in order to delete, from recorded audio data, a head portion of the data corresponding to the second set time T2 from the beginning of the recorded audio data.

If the recording time has not exceeded the first set time T1 (NO determination at step R2), or after the deletion of the data of the head portion at step R3, a further determination is made, at step R4, as to whether reproduction of automatic performance data, requiring protection of the copyright Sa, is to be started. If answered in the affirmative at step R4, the flow proceeds to step R5, where recording inhibition of the automatic performance data is set to thereby impose a predetermined recording restriction. In the first embodiment of the recording process, for example, the audio data recording is temporality stopped with limitations set on the recording portion, while, in the second embodiment of the recording process, the data to be recorded are limited such that recording of only automatic performance sound data SA formed on the basis of automatic performance data is inhibited (i.e., the automatic performance sound data SA are not recorded). Thus, in both embodiments, at least the recording of the produced tones based on the automatic performance sound data SA requiring copyright protection is inhibited.

With a NO determination at step R4, or after the recording restriction operation at step R5, a further determination is made, at step R6, as to whether reproduction of automatic performance data, requiring protection of the copyright Sa, has been completed. If the reproduction of the automatic performance data, requiring protection of the copyright, has been completed as determined at step R6, the flow moves on to step R7, where the restriction operation at step R5 is invalidated so that the recording inhibition of the automatic performance data is reset to cancel the recording restriction. In the first embodiment of the recording process, the recording having so far been temporarily stopped (paused) is resumed, while in the second embodiment of the recording process, the recording inhibition of the automatic performance data SA alone is canceled.

If the reproduction of the automatic performance data, requiring protection of the copyright, has not been completed (NO determination at step R6), or after the recording restriction cancellation operation at step R7, a further determination is made, at step R8, a shift has been made to a "tone signal (performance sound data SA, SB) formation present" state after "tone signal (performance sound data SA, SB) formation absent" state lasted in the tone generator circuit 8 for the third set time T3 or longer. If the "tone signal (SA, SB) formation absent" state that lasted for the third set time T3 or longer has shifted to the "tone signal (SA, SB) formation present" state (YES determination at step R8), the flow goes on to step R9, where a marking is made to (or recorded at) a time position the fourth set time T4 after the time of the state shift.

If no shift has been made to the "tone signal (SA, SB) formation present" state after the "tone signal (SA, SB) formation absent" state lasted for the third set time T3 or longer (NO determination at step R8), or after the marking operation at step R9, a further determination is made, at step R10, as to whether a jump instruction has been given along with a marking position designation. If a marking position has been designated by operation of the marking position designating switch and a jump has been instructed by operation of the jump instructing switch as determined at step R10, the flow proceeds to step R11, where a read pointer to the recorded audio data SR is returned to the designated marking position, and reproduction of the recorded audio data SR is started with the pointer position as a readout start position (; however, the recording is still continued).

If it is determined that no jump instruction with a marking position designation has been given (NO determination at step R10), or after the operation for starting reproduction at the marking position at step R11, the flow goes to step R12, where a determination is made as to whether an instruction for storing cut-out data has been given along with a marking position designation.

If it is determined that the cut-out data storage has been instructed through operation of a storage instructing switch and a marking position has been designated through operation of the marking position designating switch (i.e., YES determination at step R12), the flow proceeds to step R13, where the recording operation is temporarily stopped or paused, but also a portion of data, corresponding to the designated marking position, is cut out or extracted from the already-recorded audio data SR and stored into the audio data storage area 4*b* of the external storage device 4. For example, if one marking position has been designated, recorded audio data SR located between the designated marking position and another marking position immediately preceding the designated marking position are stored into the audio data storage area 4*b*. If two marking positions have been designated, recorded audio data SR located between the designated two marking positions are stored into the audio data storage area 4*b*. After the recorded audio data storage operation, the recording operation is resumed.

If no instruction for storing cut-out data has been given along with a marking position designation (NO determination at step R12), or after the audio data storage operation at step R13, a further determination is made, at step R14, as to whether a recording end instruction has been given. If no such recording end instruction has been given (NO determination at step R14), the flow reverts to step R2. The operations of steps R2-R14 are repeated as long as no recording end instruction is given. Once a recording end instruction is given (YES determination at step R14) by powering-off of the apparatus or operation of a mode canceling switch, this recording process is brought to an end.

Although preferred embodiments of the present invention have been described with reference to the accompanying drawings, the above-described embodiments are just illustrative, and various modifications of the present invention are also possible without departing from the basic principles of the present invention. For example, the first set time T1 used in the constant recording can be selected as desired by a user (human player). Similarly, the third set time T3 to be used as a reference time for the marking and the fourth set time T4 to be used for determining a marking position can be selected as desired by the user (human player). For example, the fourth set time T4 can be set at "0" so that the marking position agrees with timing at which the tone generator starts forming a tone signal.

The automatic performance data, which requires copyright protection, can be any form of data, such as song data or automatic accompaniment data. Further, such automatic performance data are not limited to those comprising MIDI data alone and also can include audio data.

Further, to the analog line output circuit 20 can be supplied not only copyright-protected outputs SQ from the second mixer 9*b* but also non-copyright-protected outputs SP from the second mixer 9*a*.

Whereas the preferred embodiments have been described above in relation to the case where constant recording is performed, the present techniques also can be carried out in cases where the recording is not constant. For example, recording can be started in response to a recording start instruction from a user and ended in response to a recording end instruction, when a recording capacity of a recording medium has been reached (or exceeded), or when a preset recording time is reached.

Further, the present invention is not to be limited to the embodiment where recording is temporarily stopped in response to the start of formation of tone signals based on automatic performance data requiring copyright protection and then resumed upon completion of the tone signal formation; for example, the recording, temporarily stopped in response to the start of formation of tone signals, can be resumed only in accordance with a recording resumption instruction from a user.

The present technique can be used to eliminate human intervention to perform particular operation for instructing resumption of the recording and prevent the user from "forgetting to perform recording-resuming operation." As a result, the present technique can be used to readily achieve recording of tone waveform signals, based on performance operation or automatic performance data, or both, while protecting copyright.

Thus, even while the copyright is being protected, the present technique allows the recording to continue so that tone signals based on user's performance operation can continue to be recorded. In this way, the present technique can be applied to record the user's performance while reproducing the automatic performance data requiring copyright protection. As a result, the present technique can be applied to readily achieve constant recording of tone waveform signals, based on performance operation and/or automatic performance data, while protecting copyright.

The present invention can be constructed and implemented not only as the apparatus invention as discussed above but also as a method invention. Also, the present invention can be arranged and implemented as a software program for execution by a processor such as a computer or DSP, as well as a storage medium storing such a software program. Further, the processor used in the present invention can comprise a dedicated processor with dedicated logic built in hardware, as well as a computer or other general-purpose type processor capable of running a desired software program.

While the present invention has been particularly shown and described with reference to preferred embodiment thereof, it will be understood by those skilled in the art that the foregoing and other changes in form and details can be made therein without departing from the spirit and scope of the present invention. All modifications and equivalents attainable by one versed in the art from the present disclosure within the scope and spirit of the present invention are to be included as further embodiments of the present invention. The scope of the present invention accordingly is to be defined as set forth in the appended claims.

This application is based on, and claims priority to, JP PA 2006-195096 filed on 18 Jul. 2006 and JP PA 2007-002541 filed on 10 Jan. 2007. The disclosures of the priority applications, in their entirety, including the drawings, claims, and the specifications thereof, are incorporated herein by reference.

What is claimed is:

1. An electronic music apparatus comprising:

a tone generator section that forms tone signals based on at least one of performance operation or automatic performance data;

a recording section that records the tone signals being generated by said tone generator section for a predetermined time; and a recording control section that inhibits recording, by said recording section, of at least the tone signals being generated by said tone generator section based on the automatic performance data requiring copyright protection, while permitting recording by said recording section of the tones being generated by said tone generation section based on at least the automatic performance data requiring no copyright protection.

2. The electronic music apparatus according to claim 1, wherein said recording section has a limited storage capacity and constantly stores therein latest tone signals for a predetermined period corresponding to the limited storage capacity.

3. The electronic music apparatus according to claim 1, wherein said recording section continues recording even when no tone signal is being supplied to said recording section, and once tone signal formation is resumed following the no tone signal, said recording section records a marking indicative of a start of a performance.

4. The electronic music apparatus according to claim 3, wherein the marking is recorded at a predetermined time before a time point at which the tone signal formation is resumed following the no tone signal.

5. The electronic music apparatus according to claim 1, wherein said recording control section:

detects whether or not the automatic performance data input to said tone generator section contains copyright information, and determines that the automatic performance data requires copyright protection when the copyright information is detected.

6. The electronic music apparatus according to claim 1, wherein said recording control section temporarily stops recording when the tone signals are being generated based on the automatic performance data requiring copyright protection, and automatically resumes recording, by said recording section, upon completion of generation of the tone signals based on the automatic performance data requiring copyright protection.

7. The electronic music apparatus according to claim 1, wherein said recording control section, for a period from the start to end of generation, by said tone generator section, of the tone signals based on the automatic performance data requiring copyright protection, inhibits recording, by said recording section, of only the tone signals being generated based on the automatic performance data requiring copyright protection.

8. The electronic music apparatus according to claim 7, wherein:

said tone generator section is for generating a plurality of channels of tone signals, and for a period from the start to end of generation, by said tone generator section, of the tone signals based on the automatic performance data requiring copyright protection, said recording control section inhibits recording, by said recording section, of the tone signals only from each of the channels that is assigned to the tone signals being generated based on the automatic performance data requiring copyright protection, while continuing recording of signals from each of the channels that is not inhibited.

9. A music information recording method for a computer functioning as an electronic music apparatus with a tone generator section that forms tone signals based on at least one of performance operation or automatic performance data, the method comprising:

a recording step of recording tone signals being generated by the tone generator section for a predetermined time; and a control step of inhibiting recording, in the recording step, of at least the tone signals being generated by the tone generator section based on the automatic performance data requiring copyright protection, while permitting recording, in the recording step, of the tone signals being generated by the tone generator section based on at least the automatic performance data requiring no copyright protection.

10. The method according to claim 9, wherein the control step temporarily stops recording, in the recording step, when the tone signals are being generated based on the automatic performance data requiring copyright protection, and automatically resumes recording, in the recording step, upon completion of generation of the tone signals based on the automatic performance data requiring copyright protection.

11. The method according to claim 9, wherein the control step, for a period from the start to end of generation, by the tone generator section, of tone signals based on the automatic performance data requiring copyright protection, inhibits recording, in said recording step, of only the tone signals being generated based on the automatic performance data requiring copyright protection.

12. The method according to claim 11, wherein:

said tone generator section is for generating a plurality of channels of tone signals, and for a period from the start to end of generation, by said tone generator section, of the tone signals based on the automatic performance data requiring copyright protection, said recording control step inhibits recording, in said recording step, of the tone signals only from each of the channels that is assigned to the tone signals being generated based on the automatic performance data requiring copyright protection, while continuing recording of signals from each of the channels that is not inhibited.

13. A non-transitory computer-readable medium containing a computer program for a computer functioning as an electronic music apparatus with a tone generator section that forms tone signals based on at least one of performance operation or automatic performance data, the program comprising:

a recording module for recording tone signals being generated by the tone generator section for a predetermined time; and a control module for inhibiting recording, by said recording module, of at least the tone signals being generated by the tone generator section based on the automatic performance data requiring copyright protection, while permitting recording, by said recording module, of the tone signals being generated by the tone generation section based on at least the automatic performance data requiring no copyright protection.

14. The non-transitory computer-readable medium according to claim 13, wherein said recording control module temporarily stops recording, by said recording module, when the tone signals are being generated based on the automatic performance data requiring copyright protection, and automatically resumes recording, by the recording module, upon completion of generation of the tone signals based on the automatic performance data requiring copyright protection.

15. The non-transitory computer-readable medium according to claim 13, wherein the control module, for a period from the start to end of generation by the tone generator section of the tone signals based on the automatic performance data requiring copyright protection, inhibits recording, by the recording module, of only the tone signals being generated based on the automatic performance data requiring copyright protection.

16. The non-transitory computer-readable medium according to claim 15, wherein:

said tone generator section is for generating a plurality of channels of tone signals, and for a period from the start to end of generation, by said tone generator section, of the tone signals based on the automatic performance data requiring copyright protection, said recording control module inhibits recording, by said recording module, of the tone signals only from each of the channels that is assigned to the tone signals being generated based on the automatic performance data requiring copyright protection, while continuing recording of signals from each of the channels that is not inhibited.

* * * * *

UNITED STATES PATENT AND TRADEMARK OFFICE

CERTIFICATE OF CORRECTION

PATENT NO. : 7,829,779 B2
APPLICATION NO. : 11/778653
DATED : November 9, 2010
INVENTOR(S) : Suzuki It is certified that error appears in the above-identified patent and that said Letters Patent is hereby corrected as shown below:

On Title Page
In Item (30), Foreign Application Priority Data is incorrect and should be corrected to include:

--Jan. 10, 2007 (JP) .....2007-002541--

Signed and Sealed this
Fifteenth Day of February, 2011

David J. Kappos

David J. Kappos
*Director of the United States Patent and Trademark Office*